United States Patent [19]

Hair

[11] Patent Number: 4,544,305

[45] Date of Patent: Oct. 1, 1985

[54] INTERLOCKING SLAB ELEMENT FOR COVERING THE GROUND AND THE LIKE

[76] Inventor: Roberta A. Hair, 7554 Wooster Rd., Cincinnati, Ohio 45227

[21] Appl. No.: 575,984

[22] Filed: Feb. 1, 1984

[51] Int. Cl.[4] ..... E01C 5/06

[52] U.S. Cl. ..... 404/41; 404/34; 52/311; 52/608; D25/80

[58] Field of Search ..... 404/34, 37–42, 404/73, 22–24; 52/311, 313, 590, 608; D25/80, 86; D92/25, 33; 273/156, 157 R

[56] References Cited

U.S. PATENT DOCUMENTS

| | | | |
|---|---|---|---|
| D. 42,404 | 4/1912 | Talamini | D92/29 |
| D. 42,405 | 4/1912 | Talamini | D92/29 |
| D. 75,761 | 7/1928 | Abraham | D25/80 X |
| D. 82,970 | 1/1931 | Bolton | D25/80 |
| 400,974 | 4/1889 | Thorn | 52/610 |
| 449,739 | 4/1891 | Hazelton | 404/41 |
| 474,339 | 5/1892 | Graham | 404/41 |
| 1,595,686 | 8/1926 | Perry | 404/42 |
| 1,740,110 | 12/1929 | Oden | 52/98 |
| 2,323,848 | 6/1943 | Shaeffer | 404/42 |
| 2,340,526 | 2/1944 | Green | 404/42 |
| 2,919,634 | 1/1960 | Plötner | 404/42 |
| 3,494,266 | 2/1970 | Baumberger | 404/41 |
| 3,897,164 | 7/1975 | Dodino | 404/41 |
| 4,128,357 | 12/1978 | Barth et al. | 404/41 |

FOREIGN PATENT DOCUMENTS

| | | | |
|---|---|---|---|
| 2257219 | 5/1974 | Fed. Rep. of Germany | 404/42 |
| 2409188 | 9/1975 | Fed. Rep. of Germany | 404/41 |
| 2609234 | 9/1977 | Fed. Rep. of Germany | 404/42 |
| 2700088 | 7/1978 | Fed. Rep. of Germany | 404/41 |
| 2751536 | 5/1979 | Fed. Rep. of Germany | 404/41 |
| 874055 | 7/1942 | France | 52/311 |
| 2222488 | 10/1974 | France | 404/41 |
| 2376270 | 9/1978 | France | 52/590 |
| 159512 | 9/1952 | Netherlands | 404/41 |
| 6415356 | 6/1966 | Netherlands . | |
| 9640 | of 1843 | United Kingdom | 404/42 |
| 610 | of 1853 | United Kingdom | 404/39 |
| 1416 | of 1868 | United Kingdom | 404/22 |
| 661054 | 5/1979 | U.S.S.R. | 404/41 |

OTHER PUBLICATIONS

MacMahon, Major P. A., R. A. *New Mathematical Pastimes,* Cambridge: University Press, 1921, pp. 55, 56.

Rampf Formen (Fourteen Pages).

Pictorial, 1983 National Concrete Masonry Association (pp. 1, 5).

Munich II Interlocking Paving Stone, Unilock Ltd., (2 pages).

*Primary Examiner*—James A. Leppink

*Assistant Examiner*—Beverly E. Hjorth

*Attorney, Agent, or Firm*—Wood, Herron & Evans

[57] ABSTRACT

An interlocking slab element for covering the ground or the like which has a main hexagonal section and at least one tail section integral therewith which are oriented substantially in one plane. The main section has a first pair of adjoining peripheral edges or faces and a second pair of adjoining minor peripheral edges or faces with the first and second pairs of minor peripheral edges or faces being oppositely disposed in spaced-apart relationship. The main section further has a pair of spaced-apart parallel major peripheral edges or faces interconnecting the first and second pairs of minor peripheral faces. The tail section has four minor peripheral faces or edges, with one of the four minor faces of the tail section being substantially coextensive in size and shape and spatially coincident with one of the minor faces of the main section. Finally, each of the major peripheral faces is approximately twice the length of the minor faces, and the inner section of each major face with the adjoining minor face defines an angle of approximately 135°, and the minor faces of the tail section define substantially a square.

21 Claims, 38 Drawing Figures

INTERLOCKING SLAB ELEMENT FOR COVERING THE GROUND AND THE LIKE

My invention is directed to uniquely shaped slab elements for covering the ground or other like surfaces. Specifically, my invention is directed to such slab elements which can be combined with other like slab elements in a variety of different orientations to form stable load-carrying surfaces in a multiplicity of different patterns.

Slab elements of differing shapes have been employed in the construction of traffic-carrying surfaces such as roadways, footways, embankments and pool decks. Typically, the slab elements are made of concrete, formed in desired shape in molds, and cured under high pressure where the slab material is compacted and hardened into the desired shape in the mold, and removed from the mold and exposed to ambient air to complete the curing cycle. The method by which such slab elements can be made are well known in the art and form no part of my invention. Hence, methods for making slab elements will not be addressed further except to note that the shape of the molds used to form prior art slab elements must be modified so as to conform to the shape of my slab elements. To construct a surface employing slab elements, the under-surface is prepared in known fashion to provide a smooth flat surface upon which to place the slab elements. The slab elements are placed one at a time such that their vertical or peripheral walls or edge faces come into close contact. The gaps between edge faces may be filled either with mortar, concrete, or other such solidifying spacer element, or, preferably, with sand which is simply poured into the gaps in a known manner. My invention is ideally suited to the latter, less costly method. The traffic load encountered by surfaces constructed in the above manner can vary from as light as pedestrian traffic to as heavy as several ton trucks and forklifts.

Slab elements employed for traffic surfaces have come in a wide variety of shapes from square and rectangular to multi-sided and irregular shaped surfaces, but a slab element's shape is known to affect the ground cover's load carrying capacity and durability. When viewed from the top, such slab elements generally fall into one of three basic categories.

The first category is a slab element which has a known and simple geometric shape, such as a rectangle, a square, a hexagon, or an octagon. This catergory is less desirable than other categories hereinafter discussed because their shapes preclude an interlock joint between adjacent slab elements. Additionally, proper utilization can require greater material and care than other slab elements and are often not satisfactory in use. For example, if such slab elements were placed in the manner expected of my invention, i.e., with sand between them, the surface would not be stable because there is no interlock. Furthermore, because there is no interlock, long, straight channels are more easily formed between the elements thus permitting rain, for example, to wash away the sand further reducing the load carrying stability of the ground cover formed with those elements. Hence, such slab elements would typically require mortar or concrete between elements. Mortar or concrete are typically more expensive than sand and are more difficult to work with.

A second category of slab element is one wherein, from a top plan view, the slab element looks substantially rectangular but the edges are deformed in such a manner as to interlock when laid next to an adjacent, identical stone. Examples of second category slab elements are shown in U.S. Pat. No. 2,919,634 and U.S. Pat. No. 3,494,266. Also included in this category are cetain multi-faced irregularly shaped slab elements such as that disclosed in U.S. Pat. No. Des. 82,970. The slab elements disclosed in the aforementioned patents overcome some of the drawbacks of slab elements discussed in the preceding paragraph because they may be interlocked. However, they are less attractive from an aesthetic standpoint. Moreover, the slab elements in this category generally may not be intermixed with other differently shaped second category slab elements as would be possible with first category slab elements to permit a wide variety of patterns to be created.

A third category of slab element, and the one with which my invention is concerned, overcomes the drawbacks of both first and second category slab elements. A third category slab element is comprised of two or more sections having the shape of first category slab elements which are combined into one integral slab element. An example of such a slab element is disclosed in U.S. Pat. No. 4,128,357. The slab element of that patent has a main section which is of a known octagonal shape, and a tail section which is of a known square shape, with the main and tail sections being formed as one slab element. The primary advantage of such an integral slab element is that it can interlock for durability and stability. A disadvantage, however, is that it is susceptible of only a few different interlocking patterns.

Another example of an interlocking slab element, referred to as a trillium design, is shown in the brochure entitled, "Munich Two Interlocking Paving Stone" from Unilock, Ltd. of Georgetown, Ontario. The trillium design is comprised of three regular hexagonal shaped sections to form a cloverleaf pattern. As already stated with respect to second category slab elements, the currently employed third category slab elements suffer a major disadvantage in that they do not lend themselves to a sufficient number of differing patterns.

An objective of my invention is to provide a slab element which lends itself to forming a large number of different, attractive, interlocking patterns. This objective is accomplished by providing a slab element which has a main hexagonal section and at least one tail section integral therewith which are oriented substantially in one plane. The main section has a first pair of adjoining minor peripheral edges or faces and a second pair of adjoining minor peripheral edges or faces with the first and second pairs of minor peripheral edges or faces being oppositely disposed in spaced-apart relationship. The main section further has a pair of spaced apart, parallel major peripheral edges or faces interconnecting the first and second pairs of minor peripheral faces. The tail section has four minor peripheral faces or edges, with one of the four minor faces of the tail section being substantially coextensive in size and shape and spacially coincident with one of the minor faces of the main section. Finally, each of the major peripheral faces is approximately twice the length of the minor faces. Preferably, in such a slab element, the intersection of each major face with the adjoining minor face defines an angle of approximately 135°, and the minor faces of the tail section define substantially a square.

By means of the foregoing angular and length relationships of that peripheral face, adjacent slab elements can be arranged in a wide variety of orientations relative to each other to provide many different interlocking patterns.

BRIEF DESCRIPTION OF THE DRAWINGS

FIG. 1 is a front perspective view of a first preferred embodiment of a slab element of my invention for covering the ground and the like.

DETAILED DESCRIPTION OF THE PREFERRED EMBODIMENTS

Figure 1:
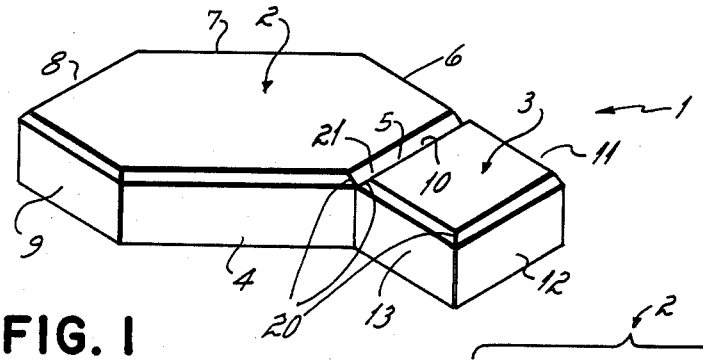

With particular reference to FIGS. 1 through 5, there is shown a slab element 1 comprised of a main hexagonal section 2 and an integral square tail section 3. The main hexagonal section 2 is comprised of six lateral faces or edges 4 through 9 around the periphery thereof. Face 4 is referred to as a first major face, and is exposed. First major face 4 adjoins a minor face 5, which is internal, to form an included angle 14 of approximately 135°. First minor face 5 adjoins a second minor face 6, which is exposed, to define an included angle 15 of approximately 90°. Second minor face 6 adjoins a second major face 7, also exposed, to define an included angle 16 of approximately 135°. Second major face 7 adjoins a third exposed minor face 8 to define an included angle 17 of approximately 135°. Third minor face 8 adjoins a fourth exposed minor face 9 to define an included angle 18 of approximately 90°. Fourth minor face 9 adjoins the first major face 4 to define an included angle 19 of approximately 135°. Each of the minor faces 5, 6, 8 and 9 are equal in length and preferably about three inches. Major faces 4 and 7 are equal in length and twice the length of any of the minor faces 5, 6, 8 and 9 and are, thus, preferably approximately six inches in length. The faces 4, 5, 6, 7, 8, and 9 lie in planes which are substantially perpendicular to the planes containing the upper and lower surface 1*a* and 1*b*, respectively, of the slab elements.

The tail section 3 is comprised of four adjoining minor lateral faces 10, 11, 12 and 13 around the periphery thereof, each of which is equal in length to the minor faces 5, 6, 8 and 9 of the hexagonal main section 2. The four minor tail faces 10, 11, 12 and 13 preferably define substantially a square when viewed from the top as in FIG. 2. Of faces 10, 11, 12, and 13, only face 10 is internal; the others are exposed.

Figure 2:
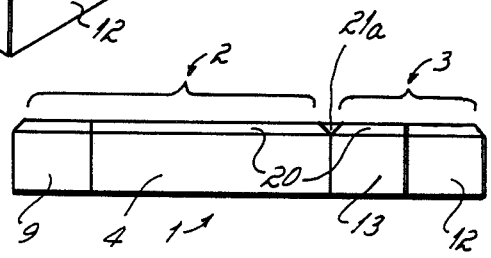
FIG. 2 is a front elevational view of the slab element of FIG. 1.

The tail section 3, which is integral to hexagonal main section 2 to form the slab element 1, adjoins at its minor internal face 10 the hexagonal main section 2 along first minor internal face 5 thereof. Minor face 10 and first minor face 5 are substantially coextensive in size and shape and spatially coincident with each other such that no portion of either of those faces extends beyond the other. The vertical plane along which minor face 10 and first minor face 5 spatially coincide is indicated by reference numeral 21. In my preferred embodiments, the upper edge of each minor and major face of each main and tail section is chamfered as indicated by reference numerals 20, 20. The chamfer is preferably 6 mm. in height and 4 mm. in depth and, as shown in FIG. 2, starts inwardly from the outer wall of the face towards the interior of its respective main or tail section 2 or 3. When the slab element 1 is thus provided with chamfers 20, 20, upper edge 21*a* of plane 21 may be viewed as a false joint in which case two identifiable polygons of known shape, namely, a hexagon and a square, are clearly discernible in slab element 1 as is especially shown in FIG. 2.

Figure 3:
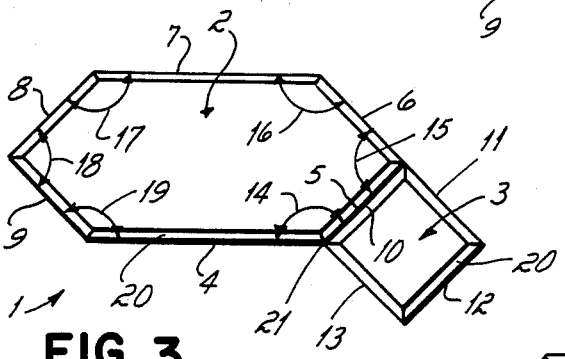
FIG. 3 is a top plan view of the slab element of FIG. 1.
Figure 4:
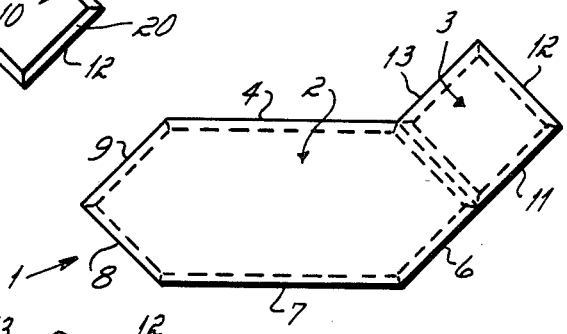
FIG. 4 is a bottom plan view of the slab element of FIG. 1.
Figure 5:
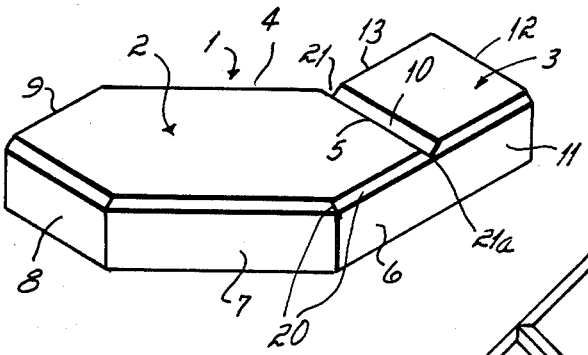
FIG. 5 is a rear perspective view of the slab element of FIG. 1.

Alternately, slab element 1 need not be provided the chamfers 20, 20 and would then appear as in the bottom plan view of FIG. 3.

Figure 6:
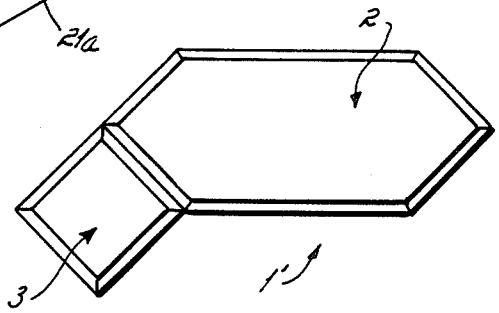
FIG. 6 is a top plan view of a mirror image of the slab element of FIG. 1 and is another preferred embodiment of a slab element according to my invention.
Figure 7:
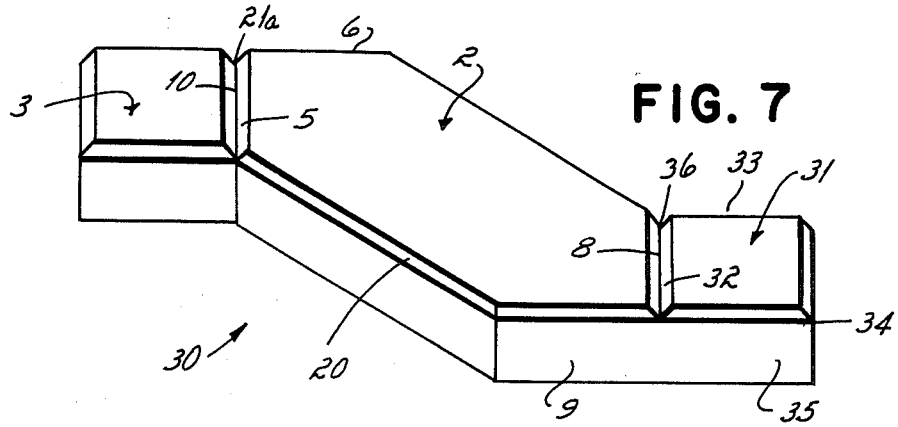
FIG. 7 is an isometric view of another preferred embodiment of a slab element of my invention.
Figure 8:
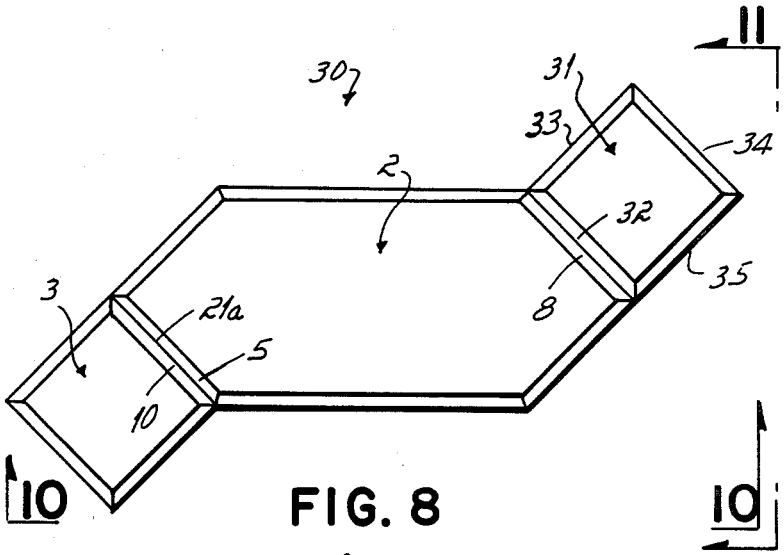
FIG. 8 is a top plan view of the slab element of FIG. 7.
Figure 11:
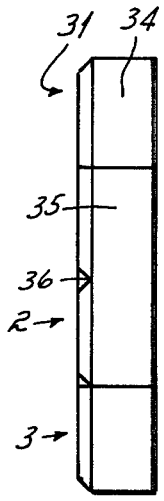
FIG. 11 is a right side elevational view of the slab element of FIG. 7 as seen along line 11—11 of FIG. 8, the left side elevational view being a mirror image thereof.
Figure 9:
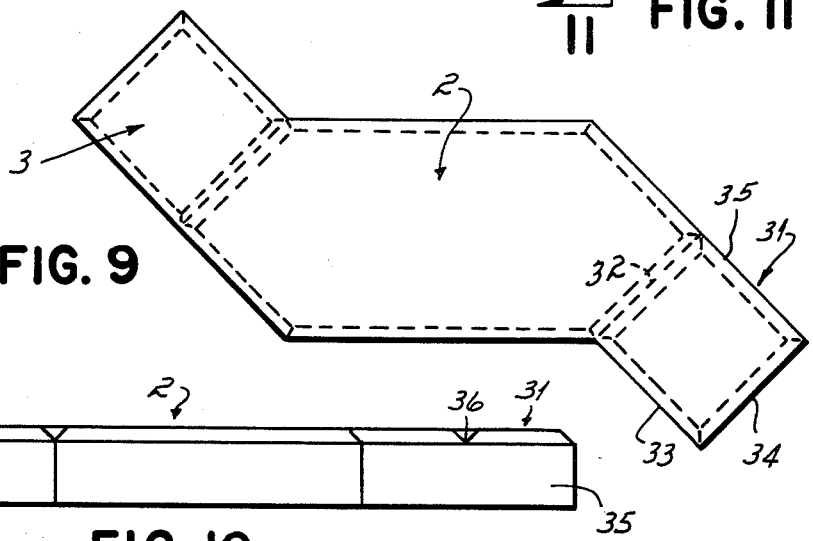
FIG. 9 is a bottom plan view of the slab element of FIG. 7.
Figure 10:
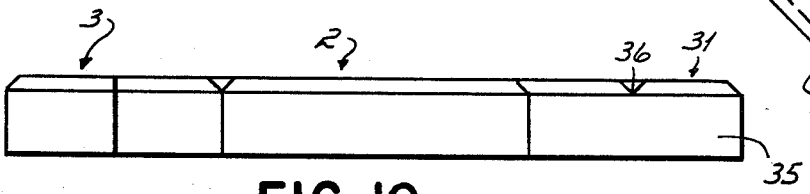
FIG. 10 is a rear elevational view of the slab element of FIG. 7 as seen along line 10—10 of FIG. 8, the front elevational view being a mirror image thereof.
Figure 12:
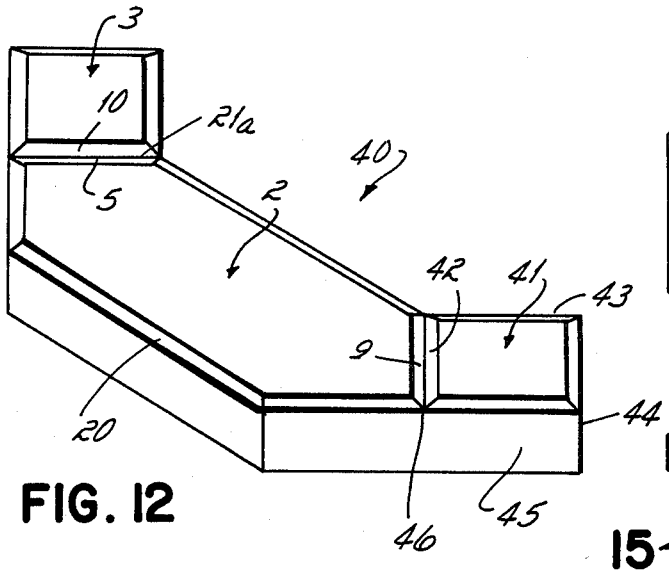
FIG. 12 is an isometric view of a further preferred embodiment of a slab element according to my invention.
Figure 14:
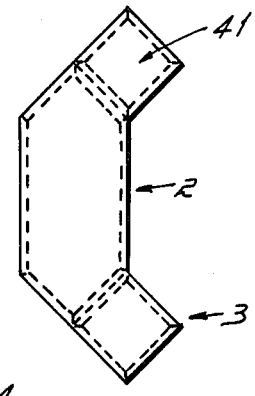
FIG. 14 is a bottom plan view of the slab element of FIG. 12.
Figure 13:
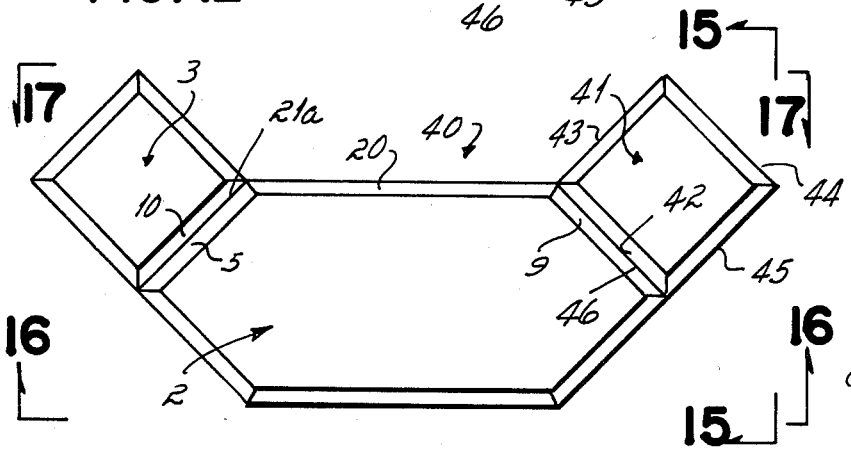
FIG. 13 is a top plan view of the slab element of FIG. 12.
Figure 15:
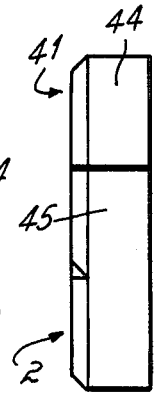
FIG. 15 is a right side elevational view of the slab element of FIG. 12 as seen along line 15—15 of FIG. 13, the left side elevational view being a mirror image.
Figure 16:
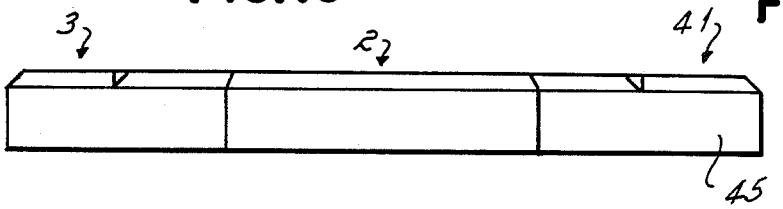
FIG. 16 is a front elevational view of the slab element of FIG. 12 as seen along line 16—16 of FIG. 13.
Figure 17:
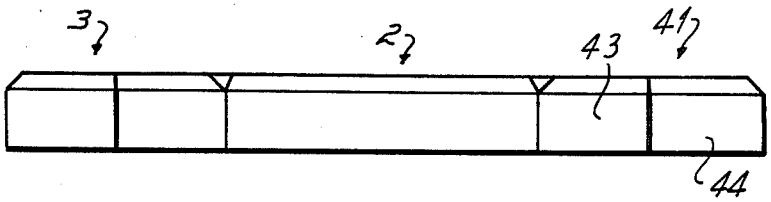
FIG. 17 is a rear elevational view of the slab element of FIG. 12 as seen along line 17—17 of FIG. 13.
Figure 18:
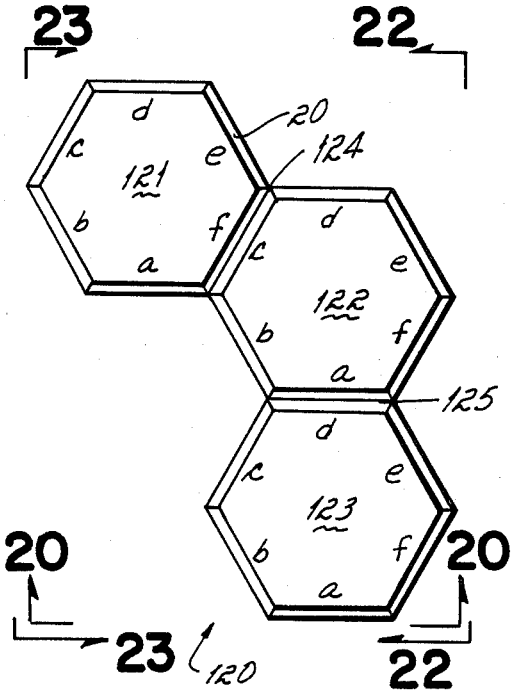
FIG. 18 is a top plan view of a still further preferred embodiment of a slab element according to my invention.
Figure 19:
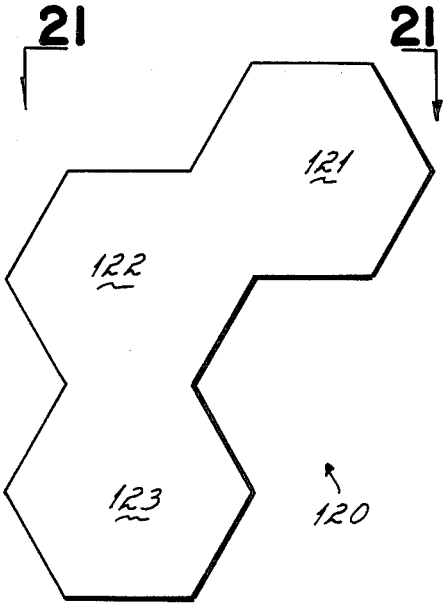
FIG. 19 is a bottom plan view of the slab element of FIG. 18.
Figure 20:
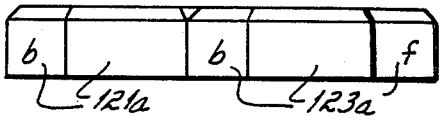
FIG. 20 is a front elevational view of the slab element of FIG. 18 as seen along line 20—20 of FIG. 18.
Figure 21:
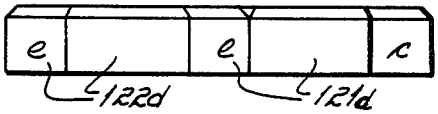
FIG. 21 is a rear elevation view of the slab element of FIG. 18 as seen along line 21—21 of FIG. 19.
Figure 22:
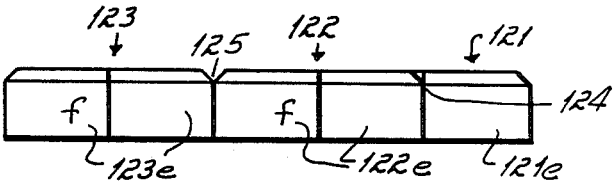
FIG. 22 is a right side elevational view of the slab element of FIG. 18 as seen along line 22—22 of FIG. 18.
Figure 23:
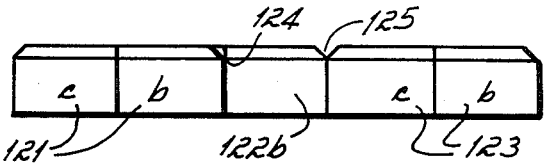
FIG. 23 is a left side elevational view of the slab element of FIG. 18 as seen along line 23—23 of FIG. 18.
Figure 24:
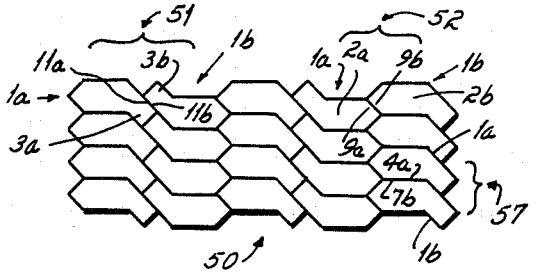
FIG. 24 is a top plan view of a repeating first closed pattern with the slab elements of FIG. 1.

In order to provide an even further variety of design from that available with the slab element 1 shown in FIG. 1, an alternative preferred embodiment generally depicted as 1' is provided as shown in top plan view in FIG. 6. Slab element 1' is identical in all respects to slab element 1 except it is a mirror image thereof. Alternatively, slab element 1' could be obtained by providing slab element 1 with chamfers 20, 20 on both the upper edge as shown as well as along the bottom edge (not depicted) and turning slab element 1 over. Providing a slab element 1 having chamfers 20, 20 along the upper edge and the bottom edge eliminates the need for an alternative slab element 1', but is not generally desirable in that false joint 21 will be created on both the top and the bottom of the slab element creating unnecessary stress concentrations and leaving less material to maintain the two sections as one integral element. Such weakening at the false joint is not desired in that the slab element could break more easily at the joint 21*a* under the stress of a heavy load, thereby losing the interlock feature sought by my invention. Moreover, having chamfers 20, 20 along the bottom edge of slab element provides an opportunity for the sand between the slab elements to slowly fill the crevices left by the chamfers on the bottom, causing the slab elements to come loose or have less stability when they are provided in an overall pattern to cover the ground as contemplated by my invention.

As more fully discussed hereinafter, a ground cover may be made by using any substantially L-shaped slab element comprised of two or more different integral sections of simple geometric shape which meet certain dimensional criteria. When such L-shaped sections are disposed in a common plane, adjacent slab elements are capable of having a wide variety of orientations with respect to each other and can result in a vast number of different interlocking patterns. To satisfy the criteria of my invention, the slab element must meet the following dimensional criteria with respect to included angles and length of faces:

(A) The slab element must be L-shaped and comprised of simple geometric integral sections;
(B) Each included angle must be a multiple of 45°;
(C) The length of each face must be a multiple of a predetermined length X;
(D) The internal spatially coincident faces of adjoining sections must be coextensive in size and shape;
(E) The length of each face must be approximately equal to the predetermined length X;
(F) The following formula must be satisfied for each included angle in each section:

$$\phi=(n/X+Z-2)45°$$

where $\phi$=included angle
Z=total number of sections in slab element
n=sum of length of the two faces defining the included angle
X=predetermined length as set forth above.

As an example, referring to FIG. 1, included angle 18 maybe determined as set out above.

Let X =3 in. n=the sum of the length of minor faces 8 and 9, each of which is 3 in. Hence, n=6 in. Z=2 as there is one main section 2 and one tail section 3. Thus, $\phi$ for included angle 18=(6 in/3 in+2−2)45°=90°. Similarly, $\phi$ for included angle 17=((3 in+6 in)/3 in+2−2)45°=135°. A review of each angle shows that it satisfies the above criteria. Hence, my slab elements 1 and/or 1' are particularly advantageous due to their ability to provide a multiplicity of different patterns which are aesthetically acceptable while employing a generally L-shaped slab element to provide the interlock feature.

Figure 37:
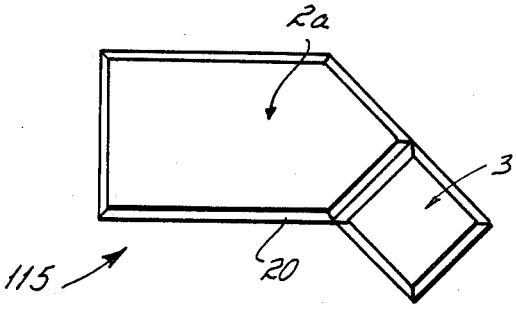
FIG. 37 is a top plan view of a first edger.
Figure 38:
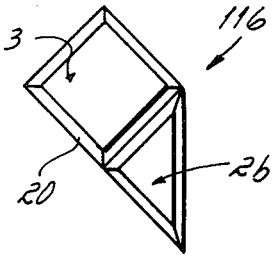
FIG. 38 is a top plan view of a second edger.
Figure 35:
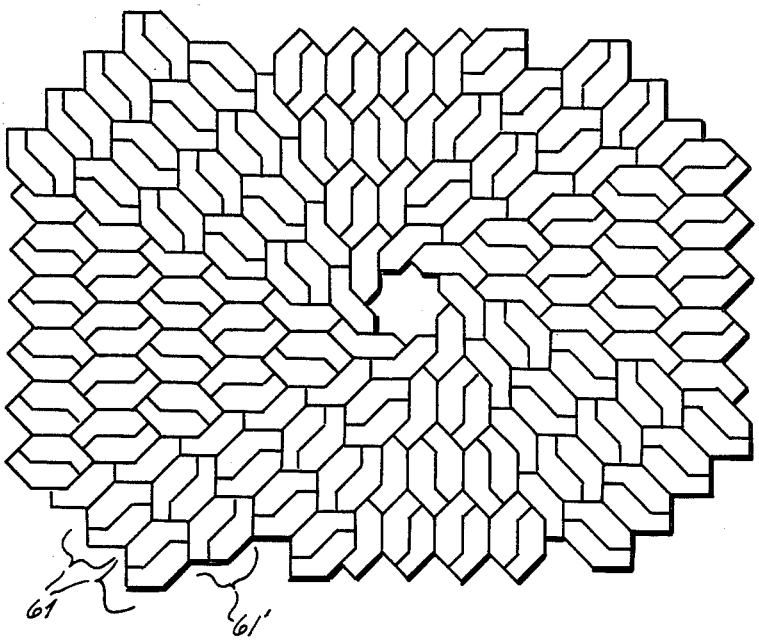
FIG. 35 is a top plan view of a repeating fourth open pattern with the slab elements of FIG. 1 and FIG. 6.
Figure 36:
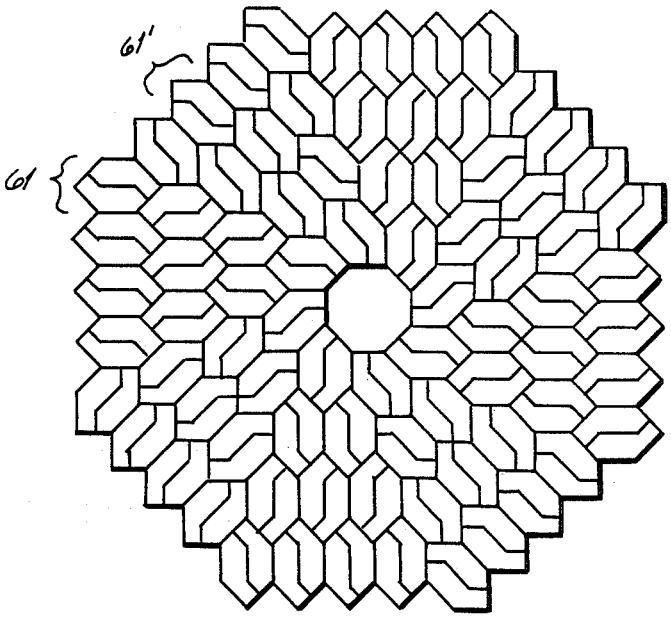
FIG. 36 is a top plan view of a repeating fifth open pattern with the slab elements of FIG. 1 and FIG. 6.

FIGS. 24 through 36 show some of the many varied patterns of ground covers which can be obtained by using slab elements 1 and/or 1' of my invention. The chamfers 20, 20 and dummy joints 21*a* have been omitted to facilitate an understanding of the manner in which the patterns may be created, but it is to be understood that it is preferred that elements with such chamfers and dummy joints be employed. Also shown is FIGS. 37 and 38 are a first edger 115 and second edger 116, respectively, which may be employed in known fashion at the periphery of the patterns formed by the ground cover where necessary to fill out the space sought to be covered. In the edgers 115 and 116, the main section 2 of a slab element 1 has been modified to main section 2*a* or 2*b*, respectively. It should be readily apparent that edgers are created by eliminating any part of a section along a line formed between two confronting face intersections. Also, preformed edges are preferable to breaking a complete slab element 1 as that could lead to frayed edges and weakened elements.

Figure 25:
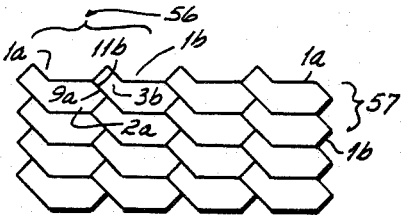
FIG. 25 is a top plan view of a repeating second closed pattern with the slab elements of FIG. 1.
Figure 26:
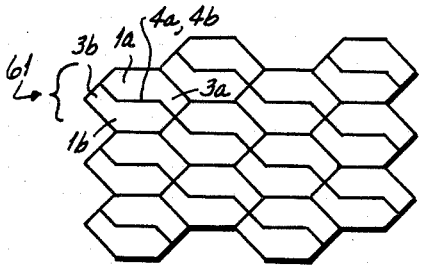
FIG. 26 is a top plan view of a repeating third closed pattern with the slab elements of FIG. 1.

Typically, the slab elements of my invention will be employed to form one of two types of patterns which I refer to as closed or open patterns. Examples of closed patterns are shown in FIGS. 24 through 31. I have used the term closed pattern to mean that there is no opening in the center or in any interior region of the pattern. Conversely, I have used the term open pattern to refer to patterns such as are shown in FIGS. 32 through 36, in which there is at least one opening in the interior of the patterns. Furthermore, a pattern is repeating where one or more repeaters, as hereinafter described, repeat in similar orientation. As will be more fully understood by reference to the drawing figures, there are a number of basic "repeaters" which are employed in all of the above patterns whether open or closed. These repeaters consist of two of my slab elements 1 and/or 1' in a particular adjoining relationship. For example, a first repeater is indicated generally at 51 in FIG. 24. First repeater 51 consists of two slab elements 1*a* and 1*b* in a common plane wherein minor faces 11*a* and 11*b* of tail sections 3*a* and 3*b* are located proximate to each other. Similarly, second repeater 52 consists of two slab elements 1*a* and 1*b* in a common plane wherein minor faces 9*a* and 9*b* of main sections 2*a* and 2*b* are located proximate to each other. As can readily be seen in FIG. 24, using a multiplicity of first repeaters 51 and second repeaters 52 results in the repeating first closed pattern 50. Upon further inspection, a third repeater 57 may be seen in FIG. 24. Third repeater 57 consists of two slab elements 1*a* and 1*b* in a common plane and in which major face 4*a* of slab element 1*a* is located proximate to major face 7*b* of slab element 1*b*. Third repeater 57 may be employed as was done in FIG. 24 by making rows of third repeaters 57 which alternate between rightside up and rotated 180°. Similarly, rows of third repeaters 57 may be employed wherein all third repeaters have the same orientation as is shown in FIG. 25 as a repeating second closed pattern 55. Also shown in FIG. 25 is a fourth repeater 56 which consists of two slab elements 1*a* and 1*b* in which minor face 9*a* of main section 2*a* of slab element 1*a* is located proximate to minor face 11*b* of tail section 3*b* of slab element 1*b*. A fifth repeater 61, shown in FIG. 26, consists of two slab elements 1*a* and 1*b* in which major faces 4*a* and 4*b* of slab elements 1*a* and 1*b*, respectively, are located proximate to each other while their tail sections 3*a* and 3*b* are spaced away from each other. As can be easily understood, fifth repeater 61 could consist of two slab elements 1' which is indicated at 61' in FIG. 29. As can also be appreciated, a plurality of fifth repeaters 61 and 61' may be employed either alone or in conjunction with single slab elements 1 and/or 1' to form a multiplicity of different patterns only some of which are depicted in FIGS. 26, 29, 30, 31, 32, 33, 35 and 36.

Figure 27:
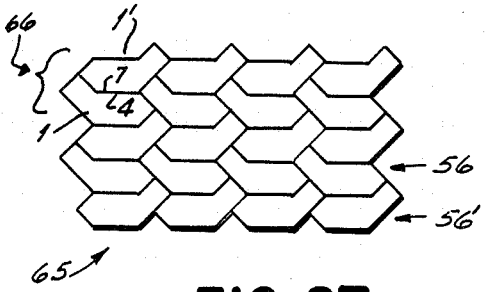
FIG. 27 is a top plan view of a repeating fourth closed pattern with the slab elements of FIG. 1 and FIG. 6.

Sixth repeater 66 is shown in FIG. 27 and, when employed in a repeating fourth closed pattern 65, also utilizes fourth repeaters 56 and 56'. Sixth repeater 66 consists of one slab element 1 and one slab element 1' wherein the first major face 4 of slab element 1 is located proximate to second major face 7 of slab element 1'. Fourth repeater 56' is virtually identical to fourth repeater 56 except that the former is made with slab elements 1' rather than slab elements 1.

Figure 28:
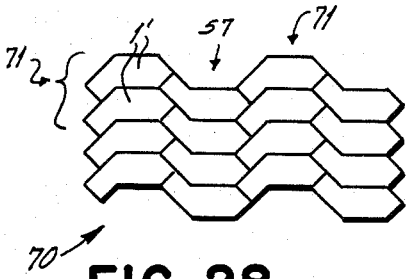
FIG. 28 is a top plan view of a repeating fifth closed pattern with the slab elements of FIG. 1 and FIG. 6.
Figure 29:
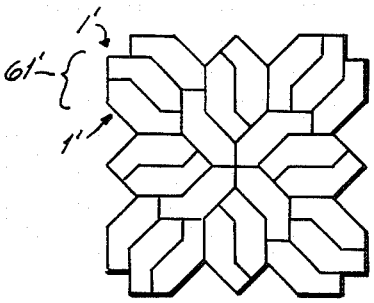
FIG. 29 is a top plan view of a sixth closed pattern with the slab elements of FIG. 1 and FIG. 6.
Figure 30:
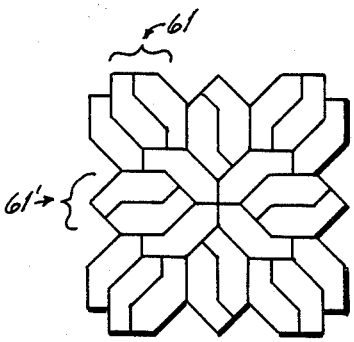
FIG. 30 is a top plan view of a seventh closed pattern with the slab elements of FIG. 1 and FIG. 6.
Figure 31:
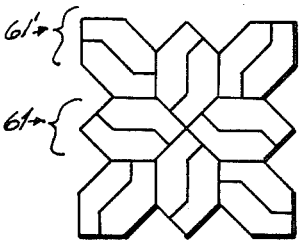
FIG. 31 is a top plan view of an eighth closed pattern with the slab elements of FIG. 1.
Figure 32:
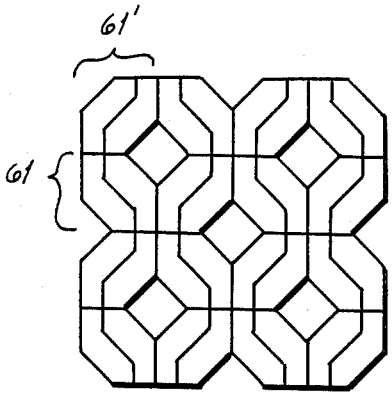
FIG. 32 is a top plan view of a repeating first open pattern with the slab elements of FIG. 1 and FIG. 6.
Figure 33:
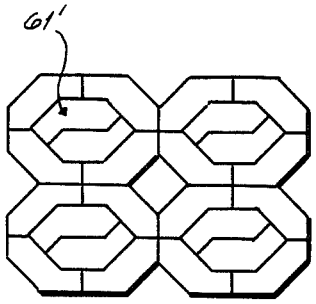
FIG. 33 is a top plan view of a repeating second open pattern with the slab elements of FIG. 1 and FIG. 6.
Figure 34:
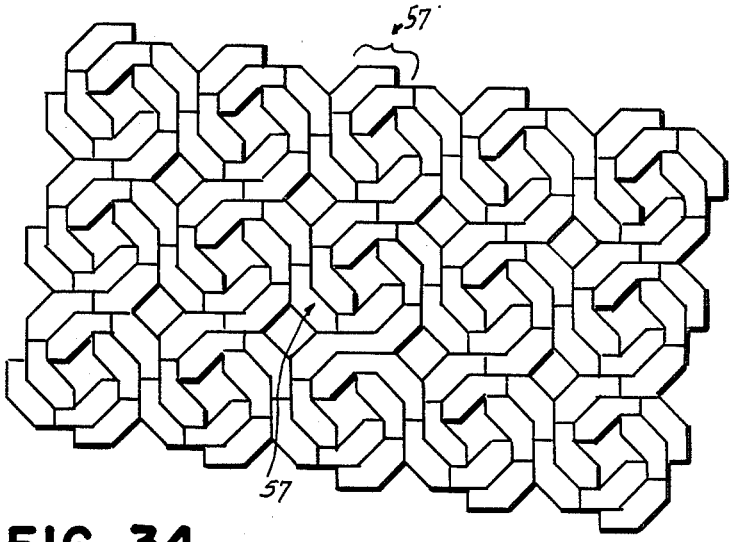
FIG. 34 is a top plan view of a repeating third open pattern with the slab elements of FIG. 1.

As was true of fifth repeaters 61 and 61', third repeater 57 may alternatively consist of two slab elements 1' as shown at 71 in FIG. 28. Further, by combining rows of third repeaters 57 with alternating rows of third repeater 71, repeating fifth closed pattern 70 is created as also shown in FIG. 28. Obviously, other repeaters may be employed with my invention, but I have chosen to illustrate only some of those repeaters for simplicity. One of ordinary skill in the art could readily arrive at other repeaters and configurations from the foregoing. Accordingly, variations thereof are contemplated without departing from the spirit or circumventing the scope of the invention as set forth in the claims hereto appended.

The varied patterns exemplified in FIGS. 24 through 36 employ a large number of slab elements disposed in a common plane with faces of each of most of those slab elements proximately located relative to faces of at least four other slab elements. That the above relationship is met is borne out by examination of any one of the several slab elements contained in the interior, as opposed to the periphery, of the above patterns and the proximate relationship had with the neighboring slab elements.

Although not susceptible to that same variety of patterns, the further preferred embodiment of my invention depicted in FIGS. 18 through 23 do provide an interlocking feature not found with their separate sections due, again, to the L-shape outline of the slab elements. The limited number of patterns possible is due solely to the similarity of each section whereas adjacent slab elements are otherwise capable of having a wide variety of orientations with respect to each other due to meeting the dimensional criteria of my invention.

With reference to FIGS. 18 through 23, there is shown another preferred embodiment of my slab element 120. Slab element 120 has three regular hexagon sections 121, 122, 123 which are integrally made into the one slab element. Each section 121, 122, and 123 may include a chamfer 20 along the upper edge of each face as hereinabove described with respect to slab elements 1 and 1'. The lateral faces 121*a* through 121*f*; 122*a* through 122*f*; and 123*a* through 123*f* of each section 121, 122 and 123, respectively, are all approximately equal in length. Sections 121 and 122 adjoin along faces 121*f* and 122*c*. Face 121*f* of section 121 and face 122*c* of section 122 are substantially coextensive in size and shape and spatially coincident such that no portion of either of those faces extends beyond the other. The upper edges of the vertical plane along which the two faces coincide is shown by reference numeral 124. When the slab element 120 is provided with chamfers 20, 20, upper edge 124 may be viewed as a false joint. Similarly, sections 122 and 123 spatially coincide at faces 122*a* and 123*d*, respectively, which are coextensive in size and shape and coincide along a vertical plane 125. Thus, the slab element 120 clearly defines an overall L-shaped slab element having three identifiable portions of the same regular hexagon shape. A ground cover (not shown) made up of a plurality of slab elements 120 would appear as though comprised of a multiplicity of single regular hexagon slab elements but would have greater stability due to interlocking than previously available for single hexagonal slab elements which do not interlock.

FIGS. 7 through 11, and 12 through 17, depict two additional preferred embodiments, respectively, of a slab element according to my invention. These two additional slab elements are substantially S-shaped rather than L-shaped and satisfy the above dimensional criteria except that $\phi=(n/X+Z-3)45°$, wherein a 3 has been substituted for the 2 in the formula. The respective slab elements 30 and 40 of these two embodiments, comprise three sections, two minor sections located on opposite sides of a single major section, as opposed to the two sections, one major and one minor, of the preferred embodiment slab element 1. Slab element 30, comprises a main hexagonal section 2 and square tail section 3 which are identical in all material respects to the same numbered sections of slab element 1' of FIG. 6. However, unlike slab element 1', slab element 30 includes a second tail section 31. Second tail section 31 is virtually identical to tail section 3 and is comprised of four peripherally adjoining minor lateral faces 32, 33, 34 and 35, each of which is equal in length to the minor faces 5, 6, 8 and 9 of the hexagonal main section 2. Lateral faces 33, 34, and 35 are external while face 32 is internal. As with tail section 3, the minor faces 32, 33, 34 and 35 of second tail section 31 preferably define substantially a square when viewed from the top as in FIG. 8. Finally, second tail section 31 is integral to hexagonal main section 2 and adjoins the hexagonal main section 2 along its now internal minor face 8 at internal minor face 32 of second tail section 31. Minor face 32 and third minor face 8 are substantially coextensive in size and shape and are spatially coincident with each such that no portion of either of those faces extends beyond the other. The vertical plane along which minor face 32 and third minor face 8 spatially coincide has its upper edge designated 36. When the slab element 30 is provided with chamfers 20, 20, 20, edge 36 may be viewed as a false joint in which case, along with false joint 21*a*, three identifiable polygons of known shape, namely a hexagon and tow squares, are clearly discernible in slab element 30 as is especially shown in FIG. 8.

Similarly, slab element 40 comprises a main hexagonal section 2, square tail section 3, and second tail section 41 which are integral. The main hexagonal section 2 and square tail section 3 are identical in all material respects to the same numbered sections of slab element 1 of FIG. 1. Moreover, second tail section 41 is virtually identical to tail section 3 and is comprised of four adjoining minor lateral faces 42, 43, 44 and 45, each of which is equal in length to the minor faces 5, 6, 8 and 9, of the hexagonal main section. Lateral faces 43, 44 and 45 are external while lateral face 42 is internal. As with tail section 3, the minor lateral faces 42, 43, 44 and 45, of second tail section 41 preferably define substantially a square when viewed from the top as in FIG. 13. Also, as with second tail section 31 in slab element 30, tail section 41 is integral to the hexagonal main section 2 of slab element 40. Second tail section 41 adjoins the hexagonal main section 2 along the now internal fourth minor face 9 of the hexagonal main section 2 at minor face 42 of the second tail section 41. Minor face 42 and fourth minor face 9 are substantially coextensive in size and shape and are spatially coincident with each other such that no portion of either of those faces extends beyond the other. The vertical plane along which minor face 42 and fourth minor face 9 spatially coincide has its upper edge designated 46. When the slab element 40 is provided with chamfers 20, 20, 20, edge 46 may be viewed as a false joint in which case, along with dummy joint 21*a*, three identifiable polygons of known shape, namely a hexagon and two squares are clearly discernible in slab element 40 as especially shown in FIG. 13.

Slab elements 30 and 40 provide the same interlocking ability as previously described with respect to slab elements 1 and 1'. Slab elements 30 and 40 however do not provide for a ground cover which can have as many varied patterns as are possible with the slab elements 1 and 1'. Slab elements 30 and 40 moreover, are particularly useful in combination with slab element 1 and 1', to provide an overall ground cover which is attractive in appearance.

Having described my invention, what is claimed is:

1. A slab element for covering the ground or other like surface comprising:

a main hexagonal section and at least one substantially square tail section integral therewith which are oriented in substantially one plane;

said main section having a first pair of adjoining minor peripheral faces and a second pair of adjoining minor peripheral faces, wherein said first and second pairs of minor faces are oppositely disposed in spaced-apart relationship; said main section further having a pair of spaced-apart, parallel major peripheral faces interconnecting said first and second pairs of minor faces;

said tail section having four minor peripheral faces wherein each of said four minor faces adjoins two other of said four faces with one of said four minor faces of said tail portion being substantially coextensive in size and shape and spatially coincident with one of said minor faces of said main section; and each of the said major faces having a length approximately twice the length of each of said minor faces.

2. The slab element of claim 1 wherein the intersection of each major face with the adjoining minor face defines an included angle of approximately 135°.

3. The slab element of claim 2, wherein each minor face and each major face has an upper edge portion which is chamfered.

4. The slab element of claim 1, wherein each minor face and each major face has an upper edge portion which is chamfered.

5. A polygonal slab element for covering the ground or other like surface comprising:

a main hexagonal section and at least one adjoining square tail section integral therewith; said main section having a first major peripheral face, a first minor peripheral face adjoining said first major face at an included angle of approximately 135° thereto, a second minor peripheral face adjoining said first minor face at an included angle of approximately 90° thereto, a second major peripheral face adjoining said second minor face at an inclined angle of approximately 135° thereto, a third minor peripheral face adjoining said second major face at an included angle of approximately 135° thereto, a fourth minor peripheral face adjoining said third minor face at an included angle of approximately 90° thereto, said fourth minor face further adjoining said first major face at an included angle of 135° thereto;

wherein each of said minor faces is approximately X in length and each of said major faces is approximately 2X in length; and a first tail section having four peripheral faces each approximately X in length wherein each of said first tail sections four peripheral faces adjoins two other of said four peripheral faces, and wherein one of said four tail section peripheral faces is coextensive in size and shape and is spatially coincident with said first minor face of said main section.

6. The slab element of claim 5 wherein each face has an upper edge portion which is chamfered.

7. The slab element of claim 5 further comprising a second square tail section integral to said main hexagonal section wherein said second tail section has four peripheral faces each approximately X in length wherein each of said second tail section four peripheral faces adjoins two other of said four faces and wherein one of four second tail section peripheral faces is substantially coextensive in size and shape and is spatially coincident with a different one of said minor faces of said main section than said first minor face.

8. The slab element of claim 7 wherein said second tail section is spatially coincident said main section along said third minor face of said main portion.

9. The slab element of claim 7 wherein slab second tail section is spatially coincident said main section along said fourth minor face of said main section.

10. A ground or similar surface cover comprising a plurality of interlocking slab elements, each slab element including:

a main hexagonal section and an adjoining square tail section integral therewith; said main section having a first major peripheral face, a first minor peripheral face adjoining said first major face at an included angle of approximately 135° thereto, a second minor peripheral face adjoining said first minor face at an included angle of approximately 90° thereto, a second major peripheral face adjoining said second minor face at an angle of approximately 135° thereto, a third minor peripheral face adjoining said second major face at an included angle of approximately 135° thereto, a fourth minor peripheral face adjoining said third minor face at an included angle of approximately 90° thereto, said fourth minor face further adjoining said first major face at an included angle of 135° thereto;

wherein each of said minor faces is approximately X in length and each of said major faces is approximately 2X in length;

said tail section having four peripheral faces each approximately X in length wherein each of said four faces adjoins two other of said four faces and wherein one of said four tail section faces is coextensive in size and shape and is spatially coincident with the first minor face of said main section;

wherein said slab elements are disposed in a common plane with faces of a substantial number of said slab elements proximately located relative to faces of at least four other of said slab elements.

11. The ground or similar surface cover of claim 10 including a plurality of a first repeatable configuration, said first repeatable configuration comprising a first and a second slab element each of which is configured substantially identically to said interlocking slab elements, said first major face of said first slab element being located proximate to said first major face of said second slab element.

12. The ground or similar surface cover of claim 11 wherein a substantial number of said first repeatable configurations are arranged such that any face of a slab element located proximate to a major face of another slab element is a major face.

13. The ground or similar surface cover of claim 10 including a plurality of a second repeatable configuration, said second repeatable configuration comprising a first and a second slab element each of which is configured substantially identically to said interlocking slab elements, one of said faces of said tail section of said first slab element being located proximate to said second minor face of said main section of said second slab element.

14. The ground or similar surface cover of claim 13 wherein in said second repeatable configuration said first major face of said first slab element is located proximate to said second major face of said second slab element.

15. The ground or similar surface cover of claim 14 wherein a substantial number of said second repeatable configurations are arranged such that any face of a slab element located proximate to a minor face of a tail section of another slab element is a main section minor face.

16. The ground or similar surface cover of claim 14 wherein a substantial number of said second repeatable configurations are arranged such that at least one tail section minor face of said slab element is located proximate to one tail section minor face of another slab element.

17. The ground or similar surface cover of claim 10 including a plurality of a third repeatable configuration, said third repeatable configuration comprising a first and a second slab element each of which is configured substantially identically to each interlocking slab elements, one of said faces of said tail section of said first slab element being located proximate to said third minor face of said main section of said second slab element.

18. The ground or similar surface cover of claim 17 wherein in said third repeatable configuration said first major face of said first slab element is located proximate to said second major face of the second slab element.

19. The ground or similar surface cover of claim 10 including a plurality of a fourth repeatable configuration, said fourth repeatable configuration comprising a first and a second slab element each of which is configured substantially identically to said interlocking slab element, one of said minor faces of said tail section of said first slab element being located proximate to one of said minor faces of said tail section of said second slab element.

20. The ground or similar surface cover of claim 10 including a plurality of a fifth repeatable configuration, said fifth repeatable configuration comprising a first and a second slab element each of which is configured substantially identically to said interlocking slab element, said fourth minor face of said main section of said first slab element being located proximate to said fourth minor face of said main section of said second slab element.

21. The ground or similar surface cover of claim 10 including a plurality of a sixth repeatable configuration, said sixth repeatable configuration comprising a first and a second slab element, each of which is configured substantially identically to said interlocking slab element, said fourth minor face of said main section of said first slab element being located proximate to one of said minor faces of said tail section of said second slab element.

* * * * *

UNITED STATES PATENT AND TRADEMARK OFFICE

CERTIFICATE OF CORRECTION

PATENT NO. : 4,544,305

DATED : October 1, 1985

INVENTOR(S) : Roberta A. Hair

It is certified that error appears in the above-identified patent and that said Letters Patent is hereby corrected as shown below:

Column 1, line 49, "catergory" should be -- category --

Column 2, line 6, "cetain" should be -- certain --

Column 9, line 62, after "four," first occurrence, add -- minor --

Column 10, line 20, "inclined" should be -- included --

Column 12, line 14, "each" should be -- said --

Signed and Sealed this

*Twenty-second* Day of *July 1986*

[SEAL]

*Attest:*

DONALD J. QUIGG

*Attesting Officer*

*Commissioner of Patents and Trademarks*